US009319763B2

(12) United States Patent
Takeuchi et al.

(10) Patent No.: US 9,319,763 B2
(45) Date of Patent: Apr. 19, 2016

(54) CART ASSEMBLY

(71) Applicant: Harman International Industries, Inc., Stamford, CT (US)

(72) Inventors: Yoshiyuki Takeuchi, Pine Mountain Club, CA (US); Jacques Spillmann, Los Angeles, CA (US); Paul Bauman, Los Angeles, CA (US)

(73) Assignee: Harman International Industies, Inc., Stamford, CT (US)

( * ) Notice: Subject to any disclaimer, the term of this patent is extended or adjusted under 35 U.S.C. 154(b) by 118 days.

(21) Appl. No.: 14/249,030

(22) Filed: Apr. 9, 2014

(65) Prior Publication Data

US 2014/0307907 A1 Oct. 16, 2014

Related U.S. Application Data

(60) Provisional application No. 61/810,103, filed on Apr. 9, 2013.

(51) Int. Cl.
*H04R 1/02* (2006.01)

(52) U.S. Cl.
CPC ..... *H04R 1/02* (2013.01); *H04R 1/025* (2013.01); *H04R 1/026* (2013.01); *H04R 2201/403* (2013.01)

(58) Field of Classification Search
CPC .. H04R 2499/11; H04R 1/02; H04R 2420/07; H04R 1/00; H04R 2499/15; H04R 3/00
USPC ..... 381/334
See application file for complete search history.

(56) References Cited

U.S. PATENT DOCUMENTS 5,000,286 A * 3/1991 Crawford ..... H04R 1/02 181/145
5,749,137 A * 5/1998 Martin ..... H04R 1/026 29/434
5,819,959 A * 10/1998 Martin ..... H04R 1/026 211/118
5,996,728 A * 12/1999 Stark ..... H04R 1/028 181/144
6,640,924 B2 * 11/2003 Messner ..... H04R 1/026 181/144
6,968,067 B2 * 11/2005 Lopez ..... H04R 5/02 381/182
7,298,860 B2 11/2007 Engebretson et al.
8,170,263 B2 5/2012 Engebretson et al.

OTHER PUBLICATIONS

SPEK-TRIX User Manual version 1.0, Adamson Systems Engineering, Copyright, 2009.
NEXO S.A.—GEO T Series User Manual V1.05, May 10, 2010.

* cited by examiner

*Primary Examiner* — Mark Blouin
(74) *Attorney, Agent, or Firm* — Brooks Kushman, P.C.

(57) ABSTRACT

A cart assembly is provided for transporting multiple loudspeakers that are stacked in a pre-assembled line array. The cart assembly includes a base and at least two wheels that are mounted to the base. A plurality of loudspeakers having a non-parallelogram cabinet are stacked on the base in a vertical line array with a splay angle between a pair of axis each extending through about a horizontal axis between adjacent loudspeakers. The cart assembly is coupled to at least one of the plurality of loudspeakers. The cart assembly and the plurality of loudspeakers arranged in the vertical line array are transported to a desired location.

17 Claims, 15 Drawing Sheets

CART ASSEMBLY

CROSS-REFERENCE TO RELATED APPLICATIONS

This application claims the benefit of U.S. provisional Application No. 61/810,103 filed on Apr. 9, 2013, the disclosure of which is incorporated in its entirety by reference herein.

TECHNICAL FIELD

One or more embodiments relate to a cart assembly for transporting a line array of loudspeakers.

BACKGROUND

A line array of speakers is a group of often similarly sized speakers positioned adjacent to one another to optimize a sound level output over a larger coverage area. Line array speaker systems are often used in large venues, such as auditoriums and concert halls, where high sound level is projected over a wide coverage area. Line array speakers provide increased directivity at various frequencies. Providing increased directivity at various frequencies extends the near-field coverage area because the coverage distance from the near field to the far field transition zone is increased with frequency. The ability of line array speaker systems to increase near field extension is known. For this reason, line arrays offer significant advantages over traditional multi-box sound systems and are often used for large venues.

To achieve a desired sound level over a desired coverage area, line arrays are strategically positioned in various places, at varying heights and angles, throughout a venue. The positioning of the line arrays is determined using equations that anticipate the performance of differently sized speakers based upon their arrangement relative to one another. The specific height of a line array, and the angle and spacing between the speakers in the line array are the main variables that govern the sound level output and coverage area of the line array. The height of an array governs the line array's directivity. The spacing of the individual speakers, which is a second-order effect, determines a lobing structure of the line array. For example, a relatively straight array may radiate the sound level desired for far field coverage. For near field coverage, the line arrays often require some degree of curvature to provide uniformity of coverage over a wider vertical angle.

Once a speaker arrangement for a given venue is determined, the speakers in the line arrays are then typically arranged and mounted on specially designed racks. Depending upon the desired arrangement, the line arrays are then suspended in the air with hanging equipment, which is referred to as a "tension" configuration herein and/or placed on the ground, which is referred to as a "compression" configuration herein. Additionally, support structure (e.g., chains) may be connected to speakers that are hung from the ceiling, such that the corresponding rigging systems are in compression. By arranging the line array speakers and articulating or curving the line array in the vertical plane at a specific splay angle, one can provide excellent coverage for listeners seated in both the near and the far fields.

Existing systems are known for transporting speakers to a venue then assembling the speakers into line arrays; suspending the line arrays; and then adjusting individual speakers in the line array to a desired configuration.

SUMMARY

In one or more embodiments a cart assembly is provided for transporting multiple loudspeakers that are stacked in a pre-assembled line array.

In another embodiment a cart assembly is provided with at least one base that is adapted to support at least one loudspeaker cabinet. At least two wheels mounted to the base and a support extends from the base and away from the at least two wheels. A locking mechanism is coupled to the support to selectively engage the loudspeaker cabinet. The locking mechanism is mounted for translation relative to the support between an engaged position and a released position.

In yet another embodiment, a cart assembly is provided with a base to support a loudspeaker array and an upright frame. The upright frame includes a proximal end that is connected to the base and a distal end spaced apart from the proximal end and adapted to pivotally connect to at least one loudspeaker of the loudspeaker cabinet array. The cart assembly also includes at least one strut for providing a translational connection between the loudspeaker array and the upright frame to allow adjustment of an azimuth angle of the loudspeaker array about the pivotal connection relative to an upright axis.

In still yet another embodiment, a method of transporting a plurality of loudspeakers is provided. A cart assembly having a base, and at least two wheels mounted to the base is provided. A plurality of loudspeakers having a non-parallelogram cabinet are stacked on the base in a vertical line array with a splay angle between a pair of axis each extending through adjacent loudspeakers. The cart assembly is coupled to at least one of the plurality of loudspeakers. The cart assembly and the plurality of loudspeakers are transported to a desired location.

As such, the cart assembly allows for the loudspeakers to be preassembled into line arrays, and then transported to the venue where the line arrays are suspended or stacked and adjusted to a desired configuration. Such preassembly of the line arrays reduces the amount of setup time at a venue, as compared to existing methods.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
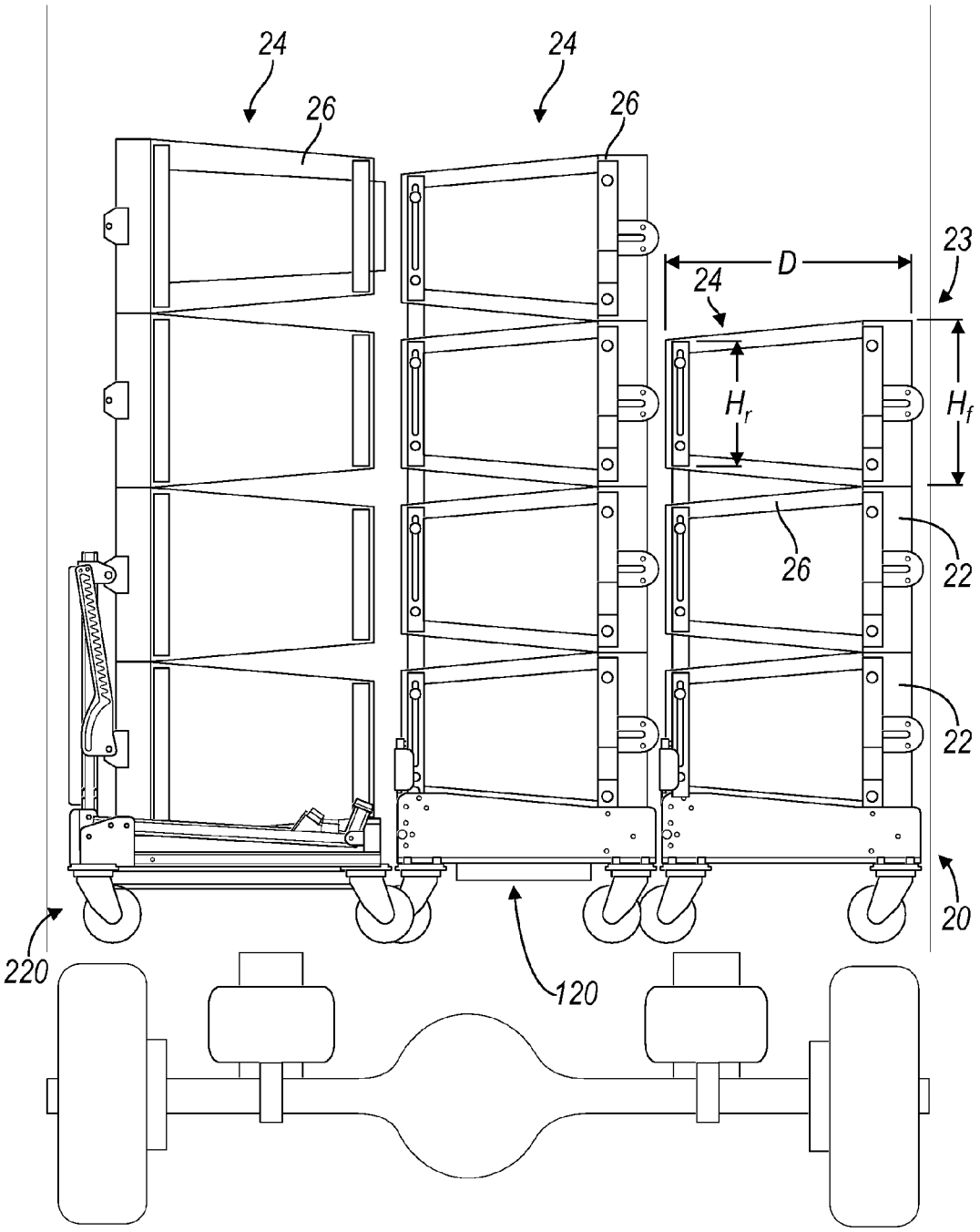
FIG. 1 is a rear view of a truck having a plurality of cart assemblies each supporting a line array of loudspeakers according to one or more embodiments.

With reference to FIG. 1, a cart assembly is illustrated in accordance with one or more embodiments and is generally represented by numeral 20. The cart assembly 20 is illustrated supporting three loudspeakers 22, which collectively provide a loudspeaker transport system 23. The loudspeakers 22 are connected to each other and preassembled into a vertical line array 24. Each loudspeaker 22 includes a rigging system 26 for connecting the loudspeaker 22 to a vertically adjacent loudspeaker 22 to form a vertical line array 24 of speaker assemblies. The cart assembly 20 is stored within a cargo area of a truck, along with cart assemblies according to other embodiments.

Existing methods are known for transporting loudspeakers individually, then assembling the loudspeakers into line arrays at a venue. However, the cart assembly 20 allows for the loudspeakers 22 to be preassembled into line arrays 24, and then transported to the venue where the line arrays 24 are suspended or stacked and adjusted to a desired configuration. Such preassembly of the line arrays 24 reduces the amount of setup time at a venue, as compared to existing methods.

Each loudspeaker 22 includes a cabinet having a non-parallelogram quadrilateral frustum shape (e.g., a square pyramid) with a longitudinal height, a lateral width and a transverse depth. The height of a front surface ("Hf") of the loudspeaker 22 is greater than a rear height ("Hr") of the loudspeaker, which allows for adjustment of the splay angle between two vertically adjacent loudspeakers 22 relative to a horizontal axis (not shown). The depth "D" of each loudspeaker 22 is approximately thirty inches, according to one embodiment. The width of a cargo area of a typical truck, such as the truck illustrated in FIG. 1, is approximately ninety-two inches, which allows for three rows of pre-assembled line arrays 24 of loudspeakers 22 to be stored within the truck.

Figure 2:
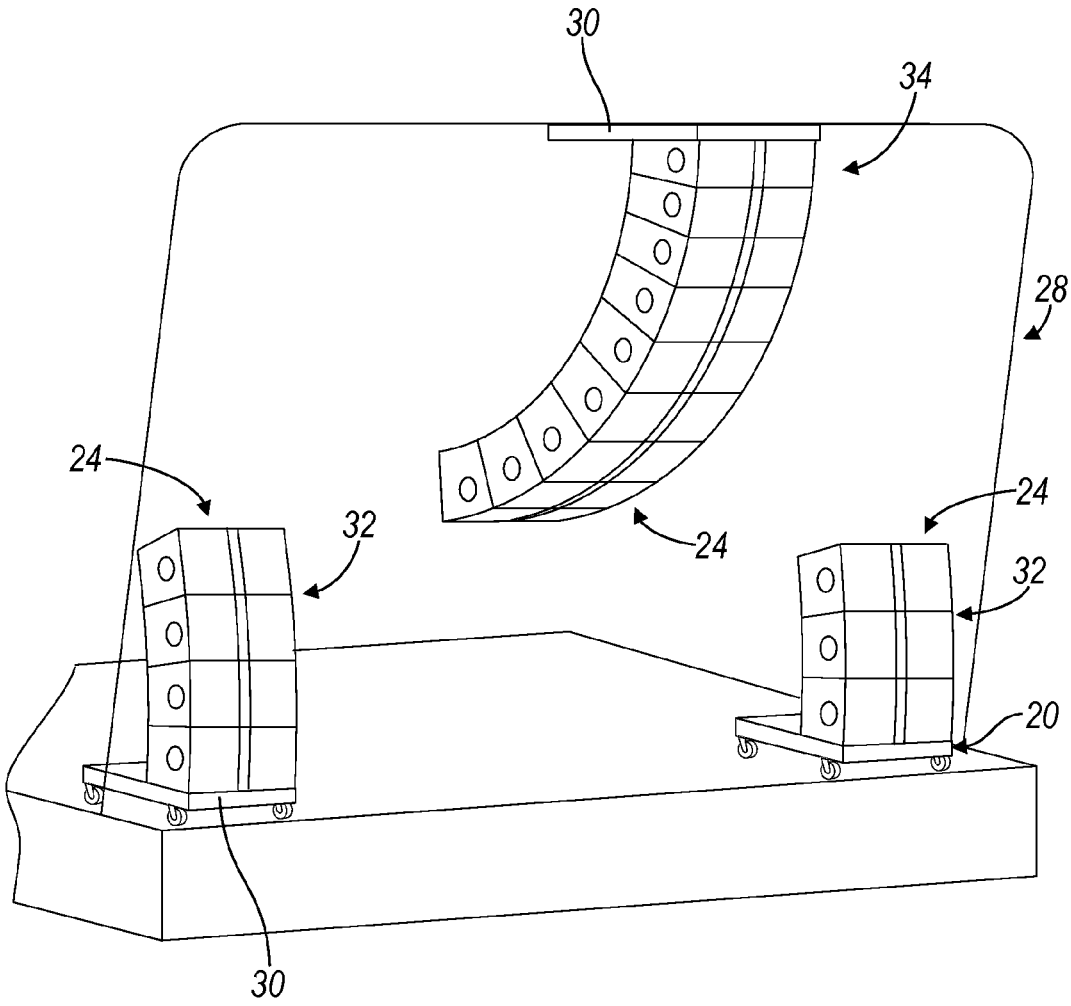
FIG. 2 is a front perspective view of a stage with loudspeakers arranged in line arrays and orientated in both tension and compression configurations.

Referring to FIGS. 1 and 2, once the truck arrives at the venue, such as a stage 28, the loaded cart assembly 20 is moved from the truck to the stage 28. The cart assembly 20 may be pushed by hand, or by a vehicle such as a fork lift. The line array 24 may remain supported by the cart assembly 20 while in use, as depicted by the line array 24 positioned at stage left. Alternatively, the line array 24 may be removed from the cart assembly 20 and attached to a base 30. The base 30 rests upon an underlying support surface (e.g., the stage 28) in a compression configuration 32, and the line array 24 of loudspeakers 22 are stacked upon the base 30. The line array 24 of speakers 22 that are stacked upon the cart assembly 20 are also in a compression configuration 32. In a tension configuration 34, the base 30 is hung from an upper support structure, and the line array 24 is suspended from the base 30.

The illustrated embodiment depicts line arrays 24 of three and four loudspeakers 22 in compression 32, and a line array 24 of eight loudspeakers 22 in tension 34. However, other embodiments contemplate line arrays 24 of more than eight or less than three loudspeakers. The number of loudspeakers 22 in a line array 24 depends on the sound requirements of a venue, the weight of each loudspeaker 22 and the load capacity of each rigging system 26.

Figure 3:
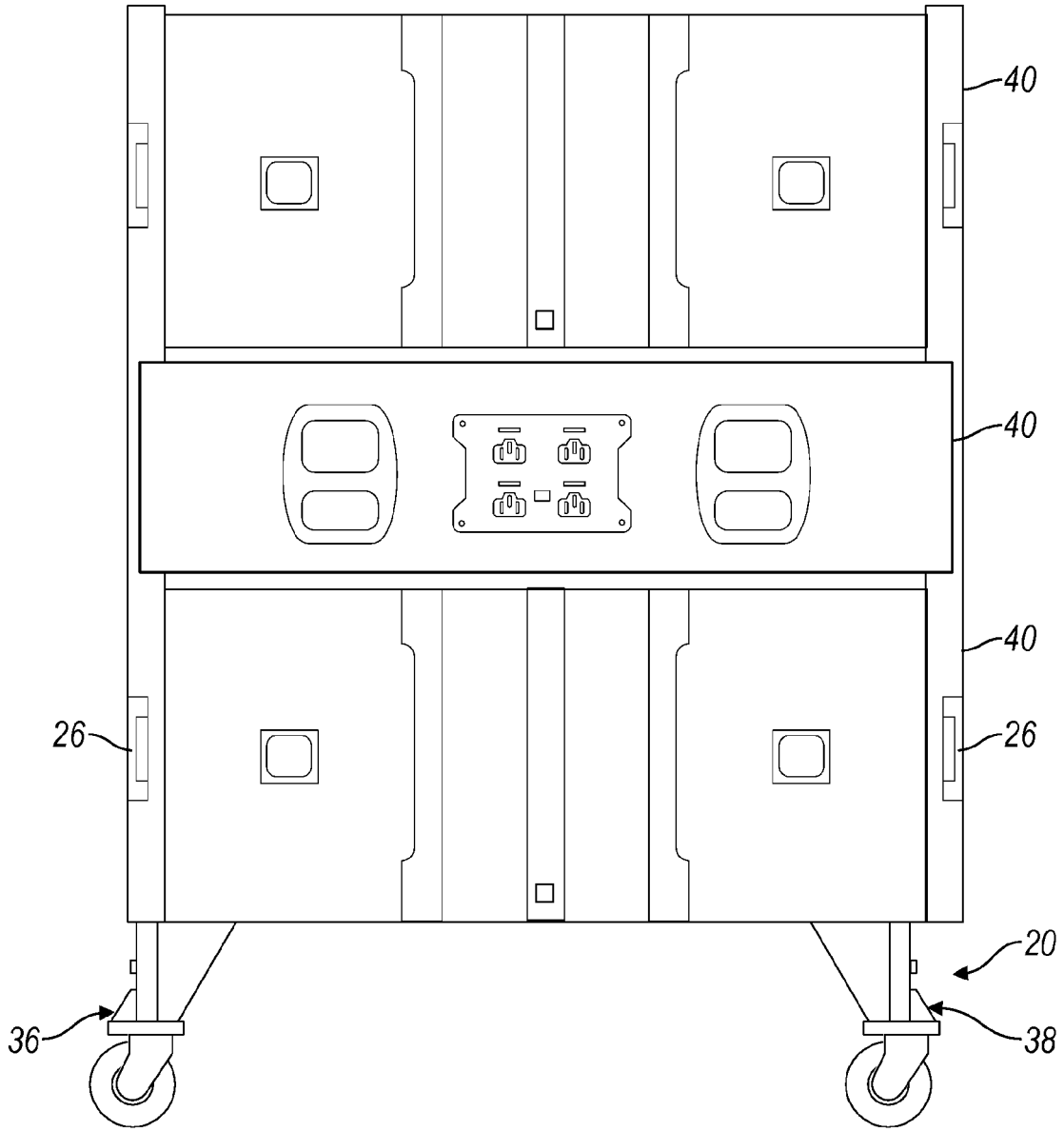
FIG. 3 is a front perspective view of a cart assembly of FIG. 1 according to one embodiment, and illustrated supporting a line array of subwoofers.

With reference to FIG. 3, the cart assembly 20 includes a first subassembly 36 and a second subassembly 38. The subassemblies 36, 38 are laterally spaced apart from each other for connecting to the rigging system 26 and supporting the line array 24 of loudspeakers 22. According to the illustrated embodiment, the first subassembly 36 connects to the rigging system 26 on the left side of the loudspeaker 22, and the second subassembly 38 connects to the rigging system 26 on the right side of the loudspeaker 22. FIG. 3 depicts the cart assembly 20 supporting a line array of three subwoofers 40 with an upper and lower subwoofer 40 oriented in a forward facing or "front-firing mode", and an intermediate subwoofer 40 oriented in a rearward facing or "reverse cardiod mode". However, in other embodiments, such as those illustrated in FIGS. 1 and 2, the cart assembly 20 may support a line array 24 of three or less loudspeakers 22.

Figure 4:
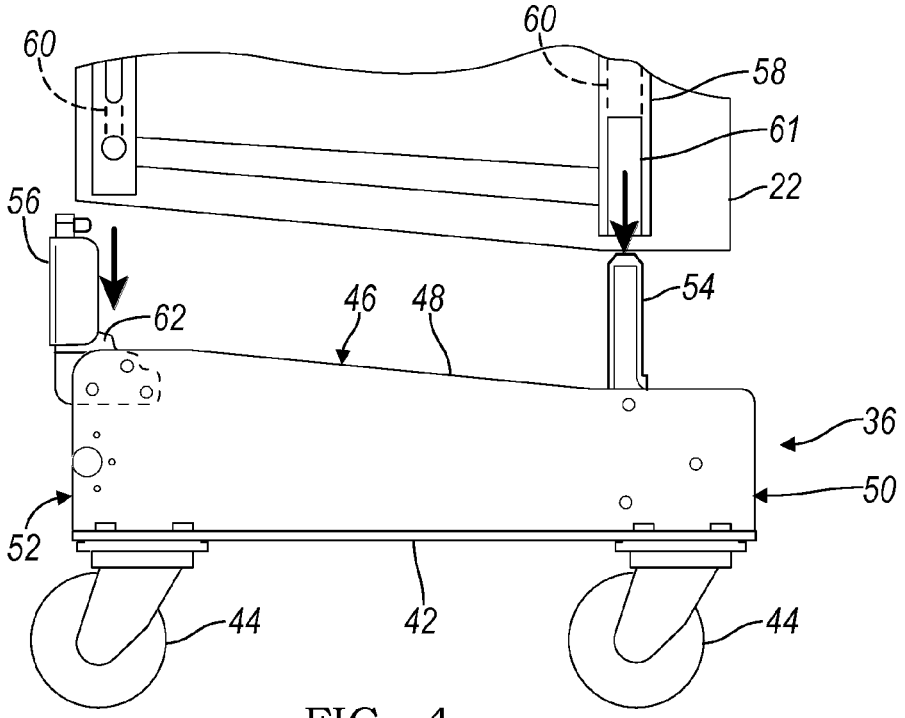
FIG. 4 is an outer side view of the cart assembly of FIG. 3, illustrated with a partial view of a loudspeaker.
Figure 5:
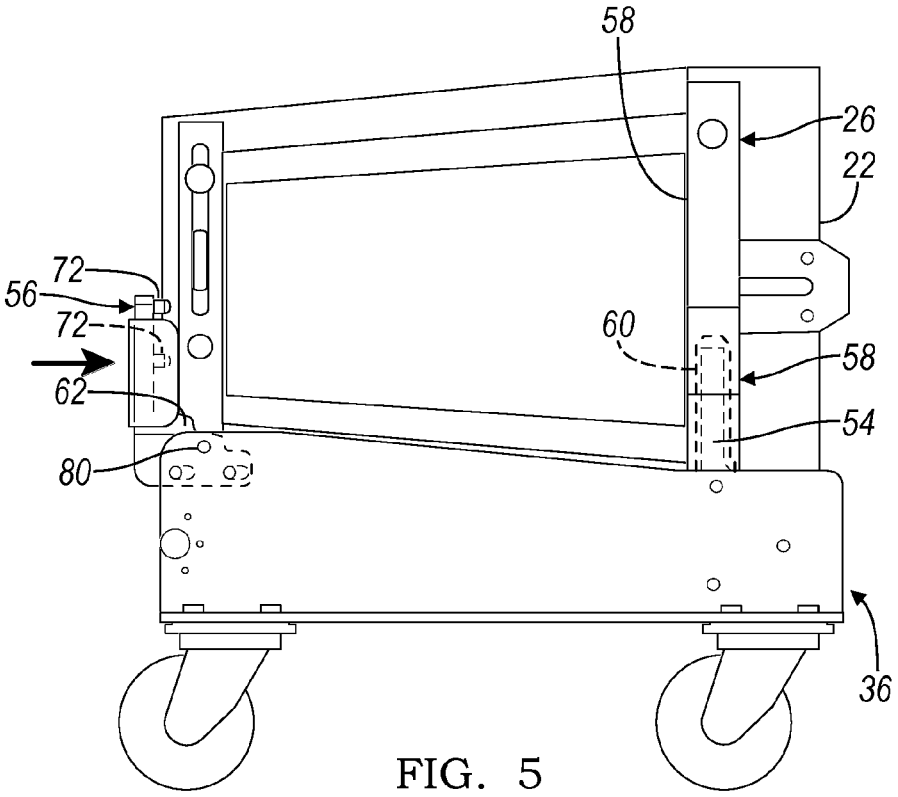
FIG. 5 is another outer side view of the cart assembly of FIG. 3, illustrated supporting a loudspeaker and oriented in a released position.
Figure 6:
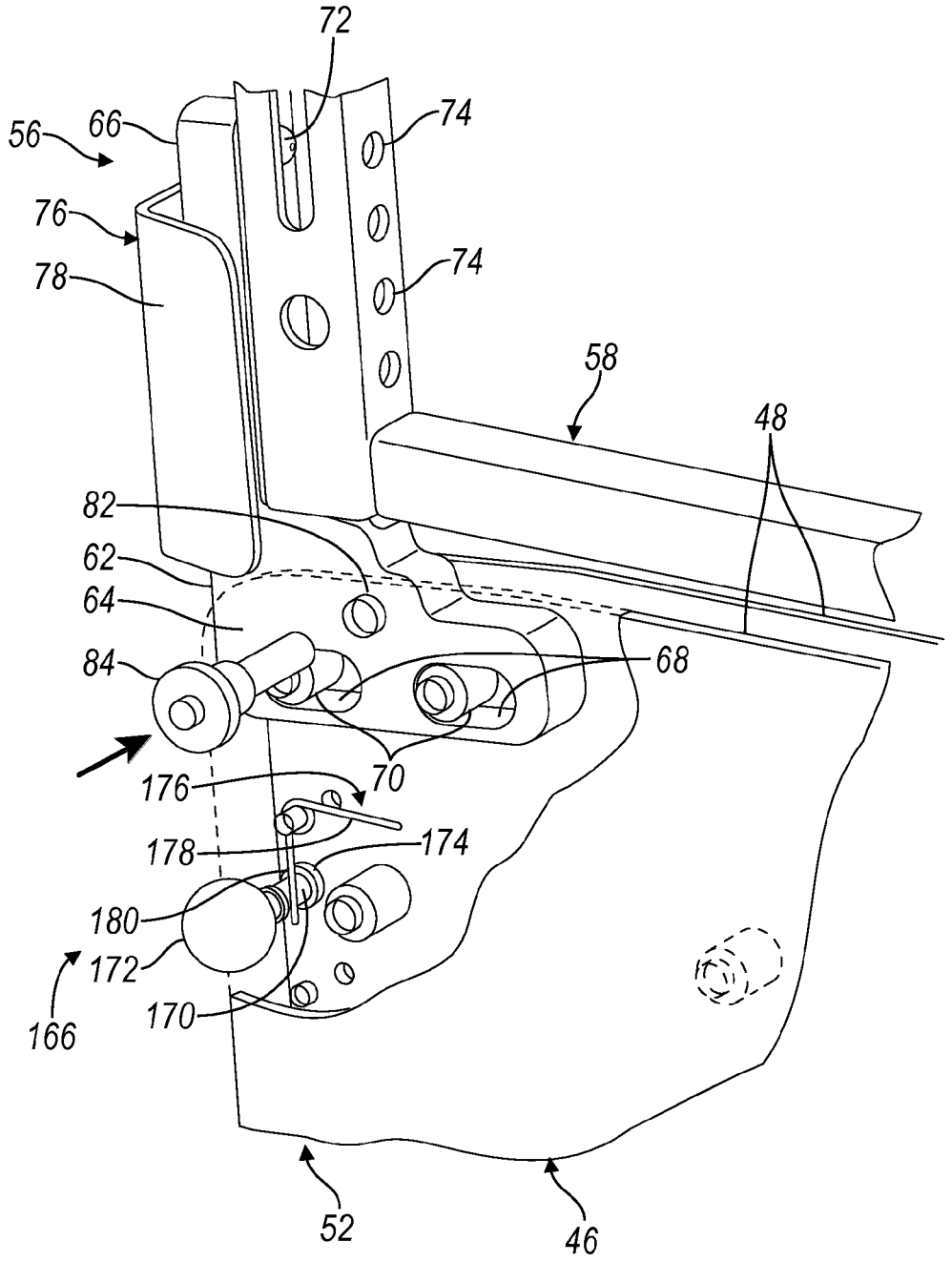
FIG. 6 is an enlarged partially fragmented side perspective view of a portion of the cart assembly of FIG. 5, illustrated supporting the loudspeaker and oriented in an engaged position.
Figure 8:
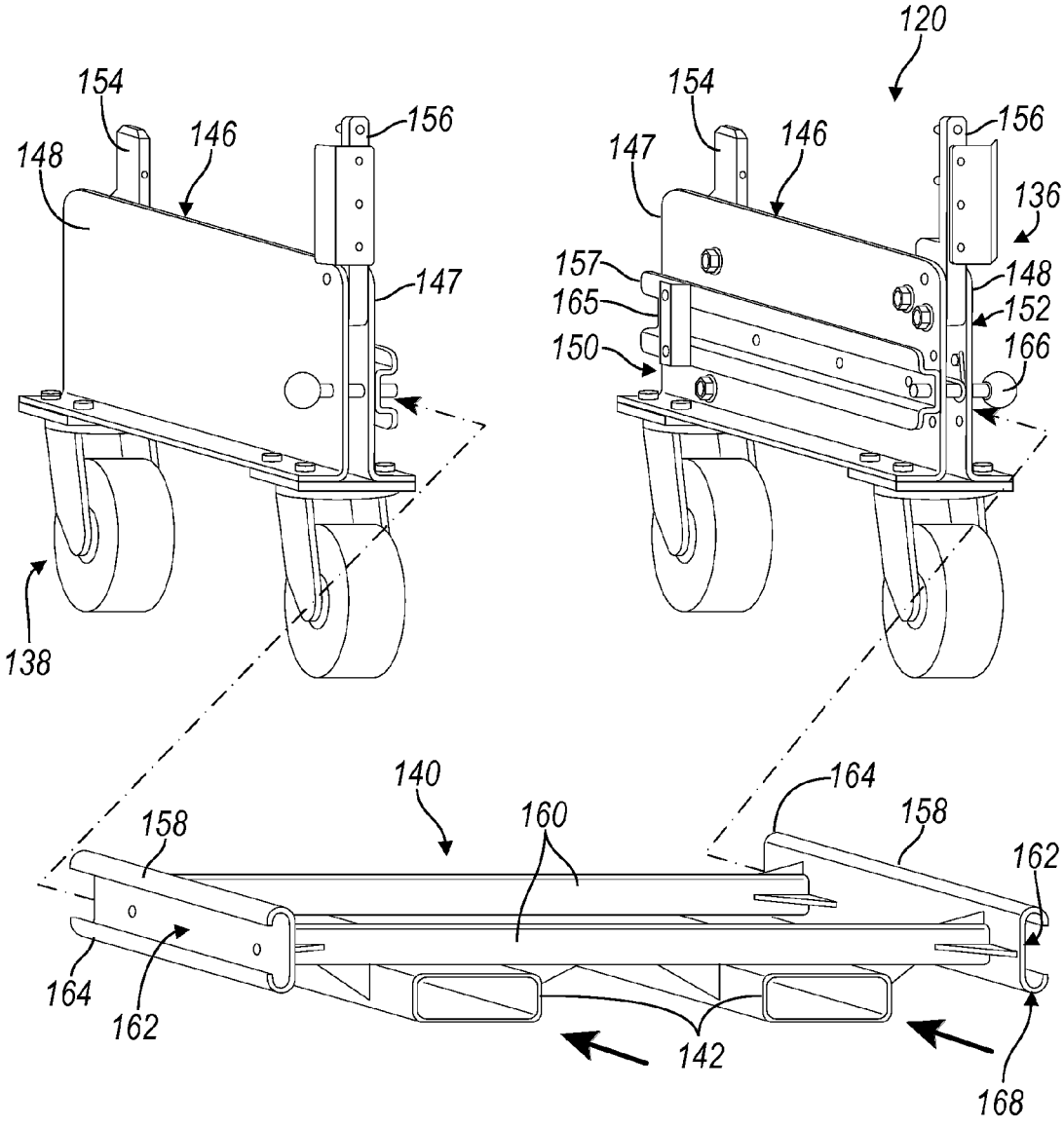
FIG. 8 is a rear partially exploded view of the cart assembly of FIG. 7.

Referring to FIGS. 4 and 5, the first subassembly 36 connects to the rigging system 26 mounted to the left side of the loudspeaker 22. The first subassembly 36 includes a base 42 with two wheels 44 mounted to a bottom surface of the base 42. In one embodiment the wheels 44 are castors with locking brakes (not shown). A support 46 extends transversely from the base 42. In one or more embodiments, the support 46 includes a pair of plates 48 that are laterally spaced apart from each other (shown in FIG. 6). In other embodiments, the base 42 may be incorporated with the plates 48 (as shown in FIG. 8). The support 46 includes a front end 50 and a rear end 52. A projection 54 extends upward from the front end 50 of the support 46, and a locking mechanism 56 extends upward from the rear end 52 of the support 46. The projection 54 and the locking mechanism 56 may be mounted between the plates 48 (as shown in FIG. 6).

The rigging system 26 includes a rigging frame 58 having a generally trapezoidal shape. The rigging frame 58 is formed from tubing that defines vertical cavities 60. These vertical cavities 60 are sized to receive hinge bars (shown in FIG. 1)

from a lower loudspeaker 22 for connecting two vertically adjacent loudspeakers 22. An opening is formed into a front lower portion of the rigging frame 58 to define a channel 61 for receiving the projection 54. The projection 54 includes a chamfered distal end that extends through the channel 61 and into a front cavity 60 of the rigging frame 58 for locating the first subassembly 36 to the loudspeaker 22.

FIG. 4 illustrates the loudspeaker 22 being lowered onto the first subassembly 36. The locking mechanism 56 includes a support surface 62. As shown in FIG. 5, a rear corner of the rigging frame 58 rests upon the support surface 62.

With reference to FIG. 6, the locking mechanism 56 is coupled to the rear end 52 of the support 46 and adapted to selectively engage the rigging frame 58. The locking mechanism 56 is mounted for translation in a fore and aft direction relative to the support 46 between a released position (shown in FIG. 5) and an engaged position (shown in FIG. 6). The locking mechanism 56 includes a first end 64 that is disposed between the plates 48, and a second end 66 that extends upward from the support 46. A pair of slots 68 are formed through the first end 64. Each slot 68 is sized for receiving a shaft 70, that extends between the plates 48. The locking mechanism 56 translates fore and aft at a distance that corresponds to the length of the slots 68. Although two slots 68 are shown in the illustrated embodiment, other embodiments contemplate a single slot for receiving the shafts 70. Alternatively, other embodiments contemplate a single slot and a single pin (not shown), which would allow the locking mechanism to pivot about the pin to a storage location between the plates 48.

A pair of pins 72 (shown in FIG. 5) extend from the second end 66 of the locking mechanism 56 in a generally horizontal direction. The pins 72 are received within apertures 74 (shown in FIG. 6) that are formed through a rear end of the rigging frame 58. The apertures 74 may be existing apertures that are also used for adjusting a splay angle between adjacent loudspeakers 22. The second end 66 of the locking mechanism 56, includes the support surface 62. The support surface 62 is sloped downward such that the support surface 62 lifts the rear end of the rigging frame 58 and the loudspeaker 22 as the locking mechanism 56 is translated forward to the engaged position. The locking mechanism 56 may also include a handle 76. The handle 76 is mounted to a rear surface of the second end 66 of the locking mechanism 56 and includes a grip 78 that is laterally spaced apart from the rigging frame 58 to provide a location for a user to wrap their fingers and pull the locking mechanism 56 rearward (aft) to disengage the locking mechanism 56 from the rigging frame 58.

The locking mechanism 56 is further adapted to be secured in the engaged position for locking the first subassembly 36 to the loudspeaker 22. A hole 80 (shown in FIG. 5) is formed through the rear end 52 of the support 46. A corresponding aperture 82 is formed through the first end 64 of the locking mechanism 56, and is aligned with the hole 80 when the locking mechanism 56 is oriented in the engaged position (FIG. 6). Both the aperture 82 and the hole 80 are sized for receiving a lock pin 84 for locking the locking mechanism 56 in the forward (engaged) position. The locking mechanism 56 and the projection 54 engage the rigging frame 58 to lock the first subassembly 36 to the loudspeaker 22 quickly, without using any additional tools. Although FIGS. 4-6 only illustrate the first subassembly 36, the second subassembly 38 (FIG. 3) includes similar components as those described with reference to the first subassembly 36, for selectively engaging the rigging frame 58 on the right side of the loudspeaker 22.

Figure 7:
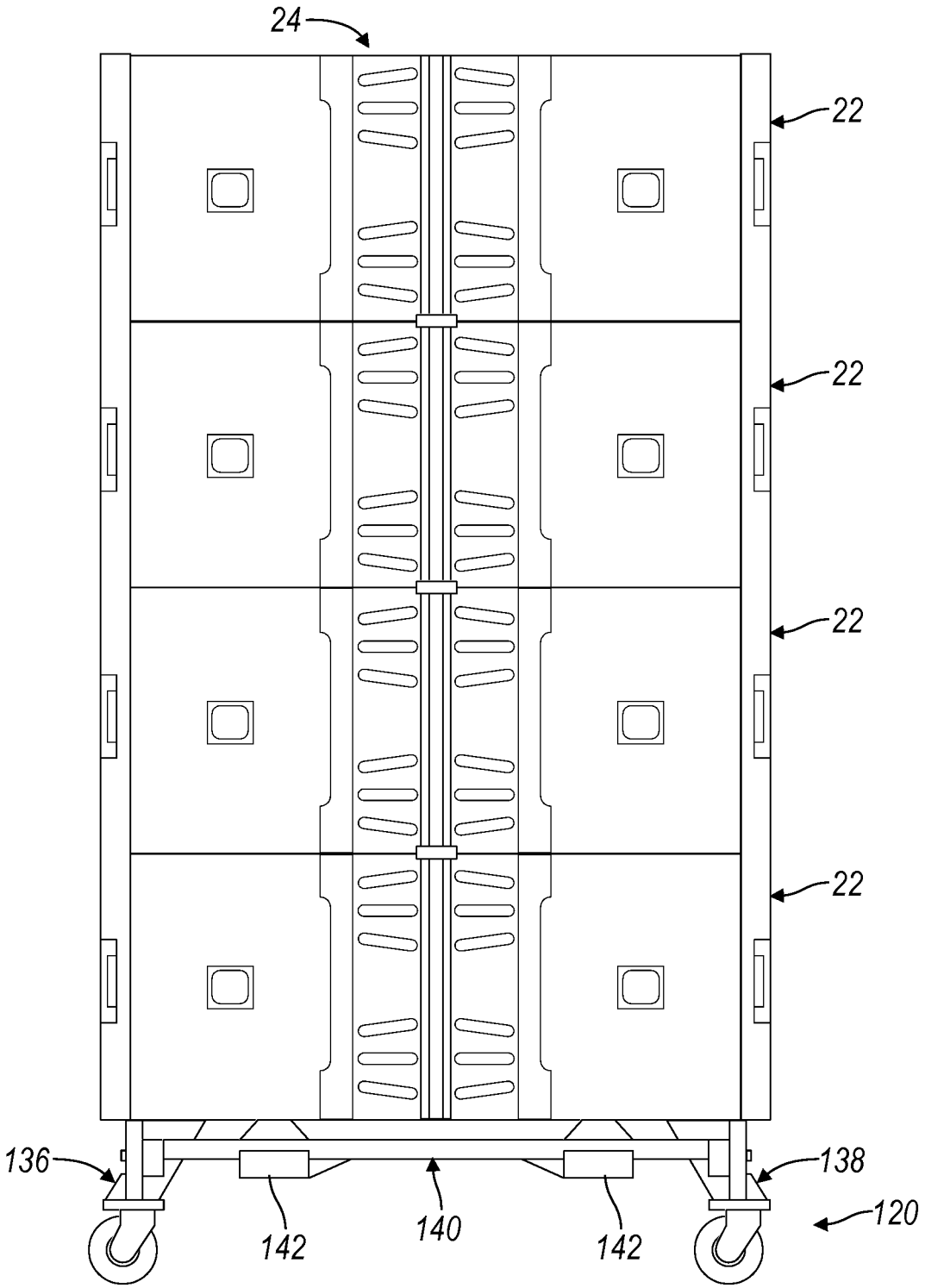
FIG. 7 is a front perspective view of a cart assembly of FIG. 1 according to another embodiment, and illustrated supporting a line array of loudspeakers.

With reference to FIG. 7, a cart assembly is illustrated in accordance with one or more embodiments and is generally represented by numeral 120. The cart assembly 120 is illustrated supporting four loudspeakers 22. The cart assembly 120 is similar to the cart assembly 20 described with reference to FIGS. 1-6, however the cart assembly 120 is configured for supporting heavier loads (e.g., more loudspeakers 22). For example, with reference to FIG. 1, the cart assembly 120 is configured to support up to four loudspeakers, whereas the cart assembly 20 is generally configured for supporting up to three loudspeakers 22, or subwoofers 40 (FIG. 3). The cart assembly 120 includes a first subassembly 136 and a second subassembly 138 that each include similar components (e.g., a projection and a locking mechanism) as the first subassembly 36 and the second subassembly 38 of the cart assembly 20.

The cart assembly 120 also includes a fork lift adaptor subframe 140 that interconnects the first and second subassemblies 136, 138 to collectively define a frame. The subframe 140 increases the overall load bearing capacity of the cart assembly 120, as compared to the cart assembly 20. Additionally, the subframe 140 includes receptacles 142 for receiving forks of a fork lift (not shown).

Each loudspeaker 22 weighs between 150 and 200 pounds, which makes the loudspeakers 22 difficult for a user to lift. Further, a line array 24 of four loudspeakers 22 may weigh between 600 and 800 lbs. Therefore it may be difficult for a user to push a loaded cart assembly 120. The subframe 140 allows a user to transport a loaded cart assembly 120 using a vehicle (e.g., a fork lift).

FIG. 8 illustrates the assembly of the cart assembly 120. Each of the first and second subassemblies 136, 138 include a support 146 having an inner plate 147 and an outer plate 148. Each subassembly 136, 138 also includes a front end 150 and a rear end 152, with a projection 154 extending from the front end 150 and a locking mechanism 156 extending from the rear end 152. Each subassembly 136, 138 also includes a guide bracket 157 that is mounted to the inner plate 147 and extends between the front end 150 and the rear end 152. According to the illustrated embodiment, the guide brackets 157 each include an upper edge that diverges from a lower edge as it extends inward and away from the inner plate 147 (e.g., a "U-Channel" bracket).

The subframe 140 is selectively attached to each subassembly 136, 138. The subframe 140 includes a pair of channeled brackets 158. The channeled brackets 158 are laterally spaced apart from each other and connected by a pair of beams 160. According to the illustrated embodiment, the channeled brackets 158 each include an upper edge that converges toward a lower edge as it extends outward (e.g., a "C-Channel" bracket) to form a channel 162. As depicted by the arrows shown in FIG. 8, the subframe 140, the channeled brackets 158 are aligned with the guide brackets 157, such that the guide brackets 157 are received within the corresponding channels 162. The subframe 140 is translated forward (e.g., from the rear end 152 to the front end 150) until a forward end 164 of each channeled bracket 158 contacts an end stop 165 that is mounted to a front end of each guide bracket 157.

Figure 9:
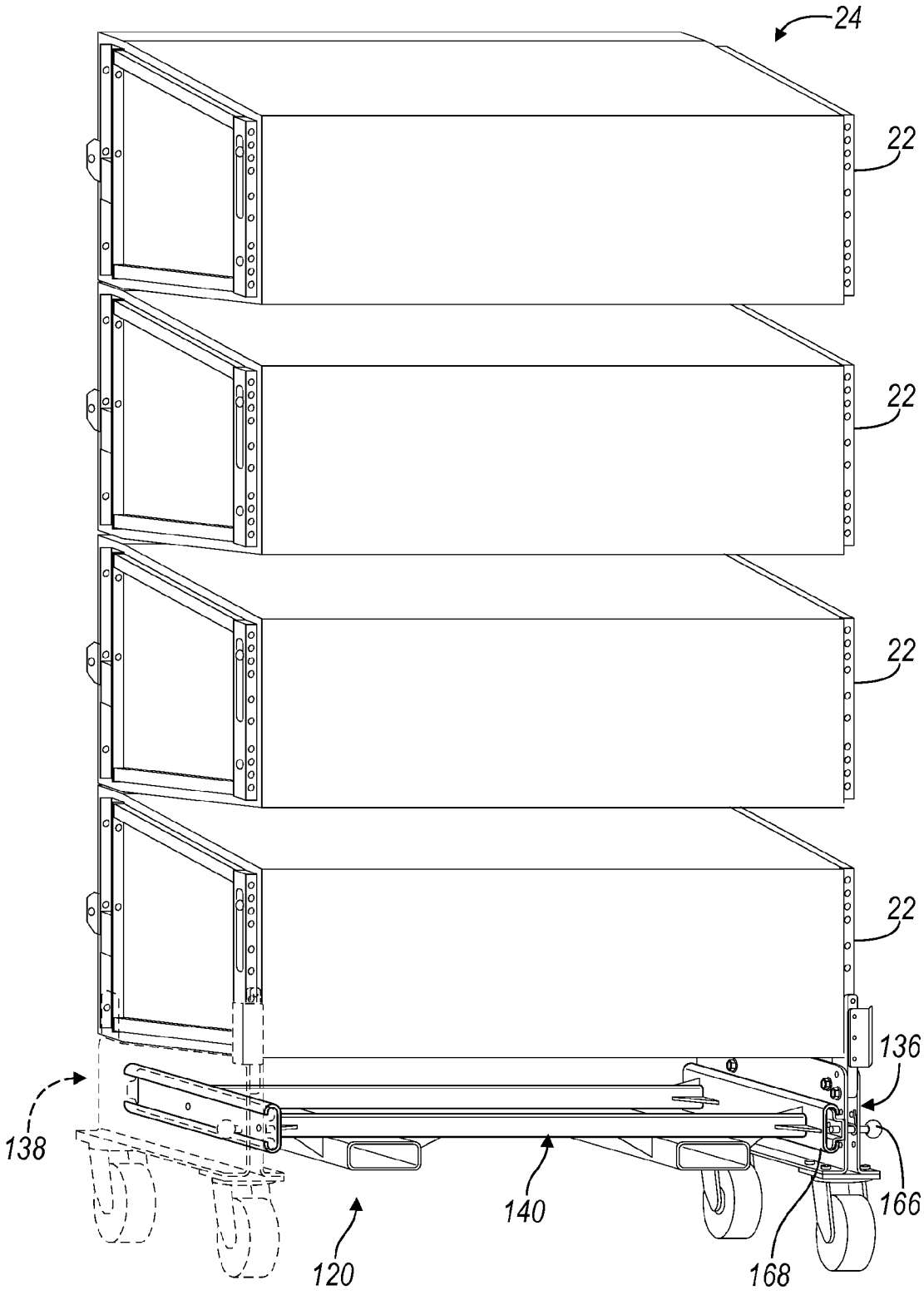
FIG. 9 is a rear perspective view of the cart assembly of FIG. 7, illustrated supporting a line array of loudspeakers.

Referring to FIG. 9, the subassemblies 136, 138 are locked to the subframe 140 according to one or more embodiments. Each subassembly 136, 138 includes a subframe lock pin 166. The subframe lock pin 166 extends through apertures formed through the plates 147, 148 and guide bracket 157 at the rear end 152 of each subassembly 136, 138. The subframe lock pin 166 is translated outward during installation of the subframe 140. Then the subframe lock pin 166 is translated inward to engage a rearward end 168 of the channeled bracket 158. The guide bracket 157 may be captured between the end stop 165 and the subframe lock pin 166, as depicted in FIG. 9. Alternatively, the channeled bracket 158 may include an aperture (not shown) formed through the rearward end 168 for receiving the subframe lock pin 166. Referring back to FIG. 6, the subframe lock pin 166 is coupled to the support 46 for limiting translation, according to one or more embodiments. The subframe lock pin 166 includes a shaft 170 with a ball 172 connected to a distal end. A flange 174 extends radially outward from an intermediate portion of the shaft 170 and is disposed between the plates 48. A retaining feature, such as a torsion spring 176 is mounted between the plates 48 and in proximity to the subframe lock pin 166. The torsion spring 176 includes a fixed leg 178 and a free leg 180. The free leg 180 is configured to engage the flange 174 when the subframe lock pin 166 is translated outward to limit translation, and prevent removal of the subframe lock pin 166. The free leg 180 is further configured to engage another feature of the pin 166 (e.g., a groove) for limiting inward translation. In other embodiments, the outer diameter of the ball 172 may contact the outer plate 48 for limiting inward translation. In one embodiment, the lateral translation of the subframe lock pin 166 is limited to approximately 0.75 in.

Figure 10:
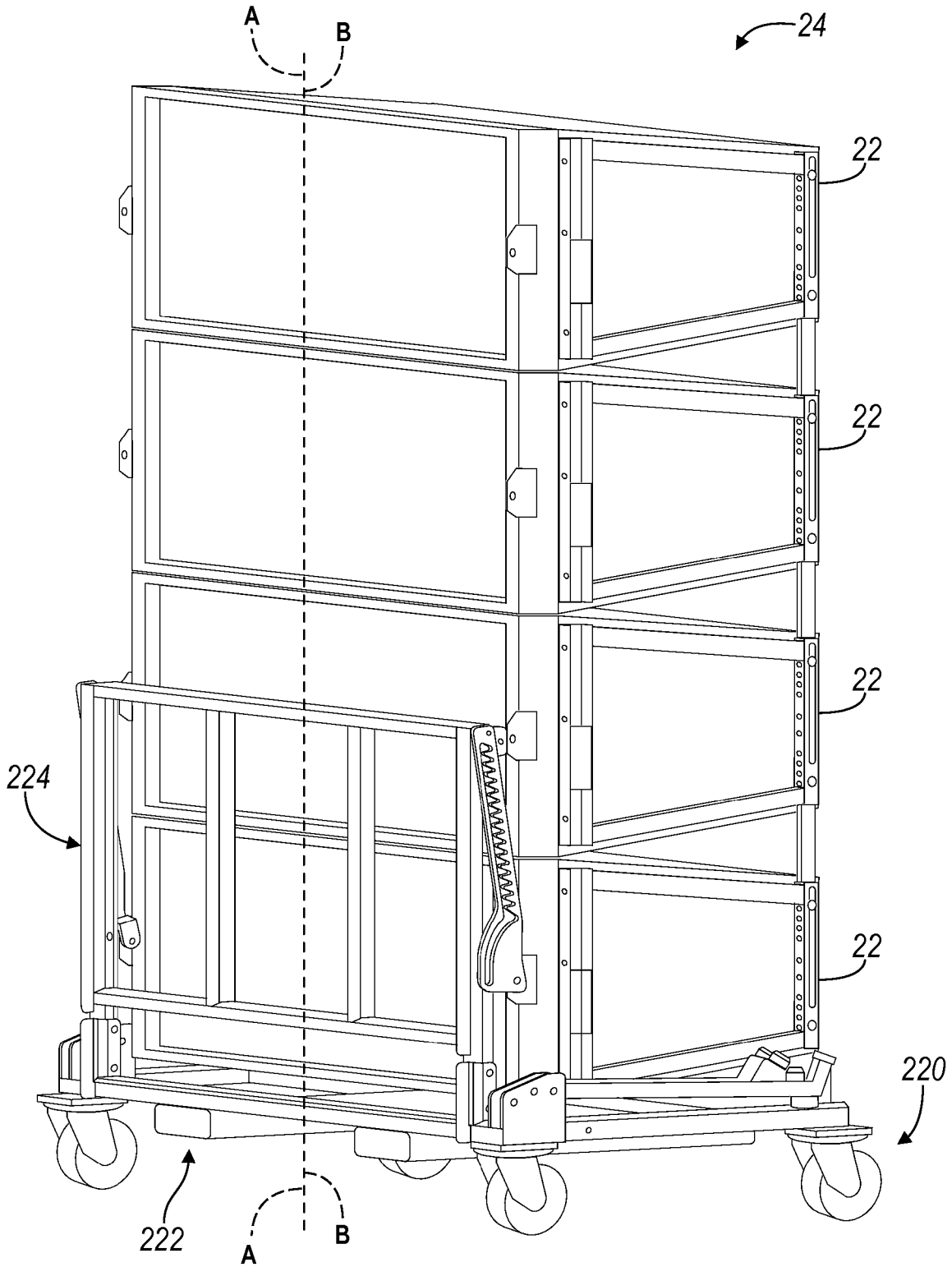
FIG. 10 is a front perspective view of a cart assembly of FIG. 1 according to yet another embodiment, illustrated in an expanded storage position and supporting a line array of loudspeakers.
Figure 16:
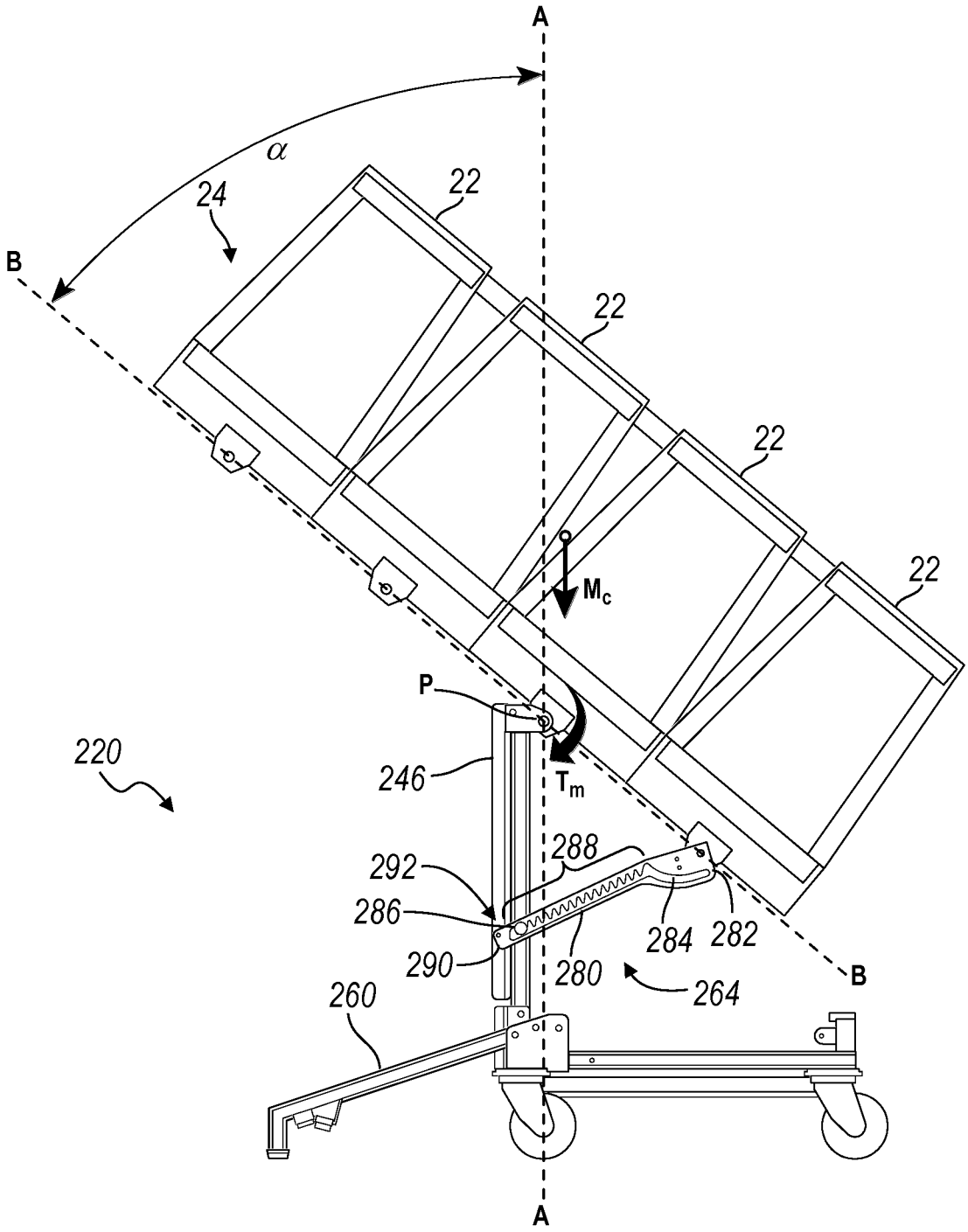
FIG. 16 is yet another side view of the cart assembly of FIG. 10, illustrated in an expanded deployed position and supporting the line array of loudspeakers at an angle offset from the upright position.

With reference to FIG. 10, a cart assembly is illustrated in accordance with one or more embodiments and is generally represented by numeral 220. The cart assembly 220 is illustrated supporting four loudspeakers 22. The cart assembly 220 is similar to the cart assemblies 20, 120 described with reference to FIGS. 1-9, in that it is configured to support a line array 24 of preassembled loudspeakers 22. However the cart assembly 220 is also configured to support the line array 24 of loudspeakers 22 as they are adjusted about an angle that is offset from an upright position (as shown in FIG. 16). Like cart assembly 120, the cart assembly 220 is configured for supporting up to four loudspeakers 22, and may be transported in the truck illustrated in FIG. 1. The cart assembly 220 includes a base frame 222 and an upright frame 224 that is connected to a front end of the base frame 222.

Figure 11:
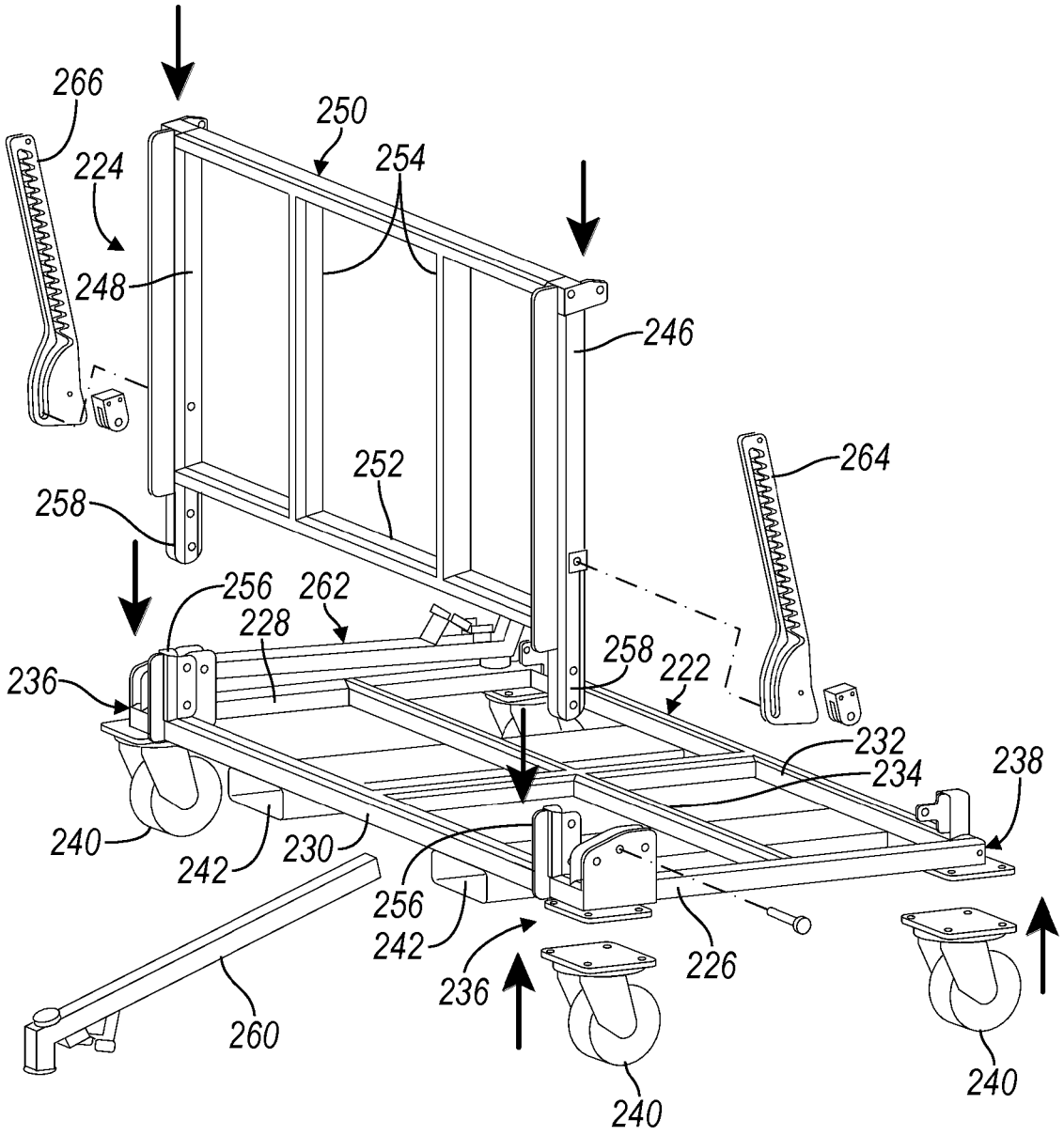
FIG. 11 is a front partially exploded view of the cart assembly of FIG. 10.

With reference to FIG. 11, the base frame 222 includes a right side beam 226 and a left side beam 228. The side beams 226, 228 are laterally spaced from each other and connected by a series of cross beams, including a front beam 230, a rear beam 232 and an intermediate beam 234. Each side beam 226, 228 includes a front end 236 and a rear end 238. A wheel 240 is mounted to a bottom surface of each end 236, 238 of each side beam 226, 228. In one embodiment the wheels 44 are castors with locking brakes (not shown). Additionally, the base frame 222 includes receptacles 242 for receiving forks of a fork lift (not shown). The receptacles 242 are mounted (e.g., welded) to a bottom surface of the cross beams 230, 232, 234 and aligned in parallel with the side beams 226, 228 according to one embodiment. A line array 24 of four loudspeakers 22 (shown in FIG. 10) may weigh between 600 and 800 lbs. Therefore it may be difficult for a user to push a loaded cart assembly 220. The base frame 222 allows a user to transport a loaded cart assembly 220 using a vehicle (e.g., a fork lift).

The upright frame 224 is pivotally connected to the front beam 230. The upright frame 224 includes a right side support 246 and a left side support 248. The side supports 246, 248 are laterally spaced apart from each other and connected by a series of cross members, including an upper member 250 and a lower member 252. The upright frame 224 may also include intermediate members 254 for interconnecting an intermediate portion of the upper member 250 to an intermediate portion of the lower member 252. A pair of pivot brackets 256 are connected to the front beam 230. A lower end 258 of each side support 246, 248 is pivotally connected to a corresponding pivot bracket 256.

Figure 12:
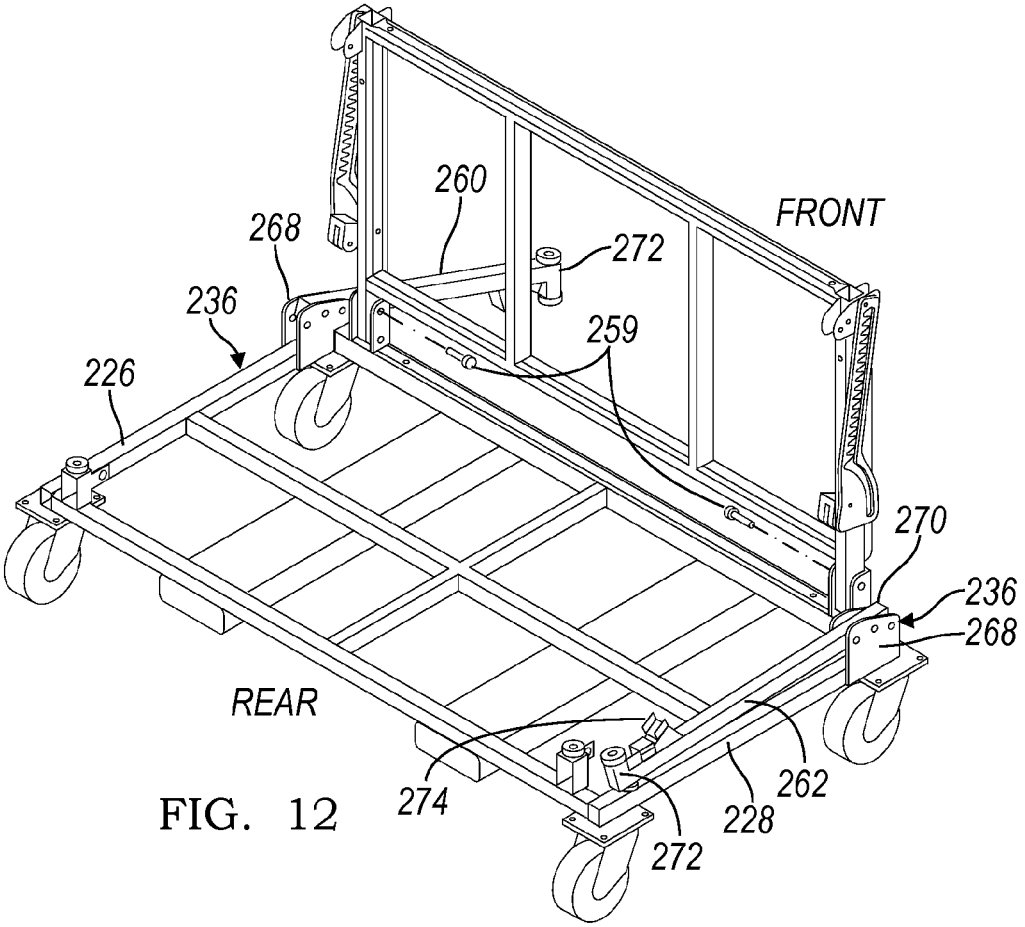
FIG. 12 is a top perspective view of the cart assembly of FIG. 10, illustrated in an expanded partially deployed position.
Figure 13:
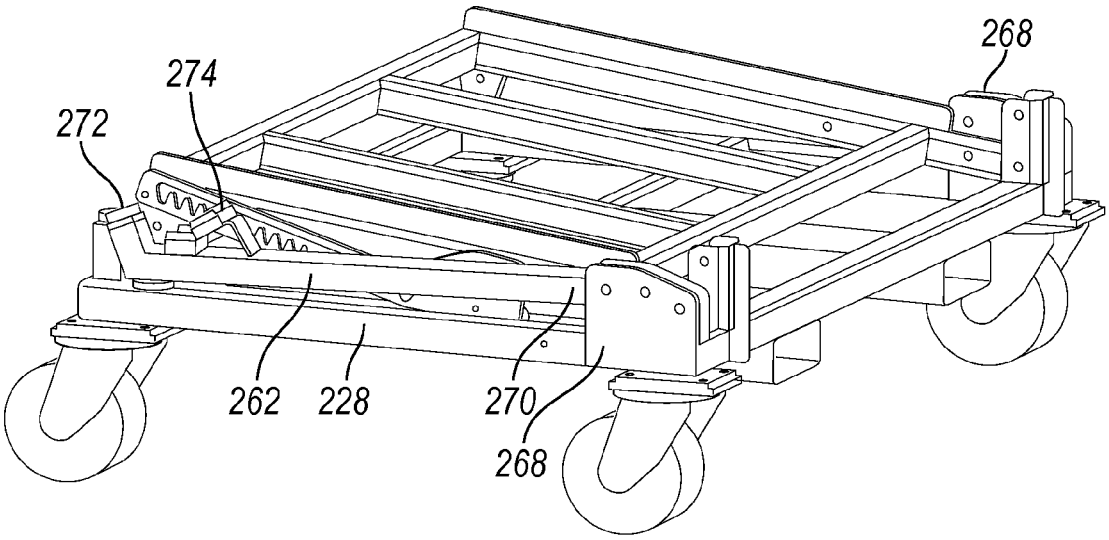
FIG. 13 is a side perspective view of the cart assembly of FIG. 10, illustrated in a collapsed storage position.

With reference to FIGS. 11-13 the upright frame 224 of the cart assembly 220 is adjustable between an expanded position (FIG. 12) and a collapsed position (FIG. 13). A pair of apertures are formed through the lower end 258 of each side support 246, 248 and align with a corresponding pair of holes formed through each pivot bracket 256. A bolt extends through the lower hole and aperture to provide the pivotal connection. As illustrated in FIG. 12, an upright lock pin 259 may be inserted through the upper hole and aperture for locking the upright frame 224 in the expanded position.

The cart assembly 220 includes a right side extension arm 260 and a left side extension arm 262 that are pivotally connected to the base frame 222 for stabilizing the cart assembly 220. The extension arms 260, 262 are adjustable between a deployed position (e.g., right side extension arm 260 in FIG. 12) and a storage position (e.g., left side extension arm 262 in FIG. 12). The cart assembly 220 also includes a right strut 264 and a left strut 266 for coupling the line array 24 of speakers 22 to the upright frame 224 for translation.

Referring to FIGS. 12 and 13, a pair of extension brackets 268 are connected to the front end 236 of each side beam 226, 228. A proximal end 270 of each extension arm 260, 262 is pivotally connected to a corresponding extension bracket 268. Each extension arm 260, 262 includes a distal end 272 that is configured to engage an underlying support surface when the cart assembly 220 is oriented in the deployed position for stabilizing the loaded cart assembly 220. In the illustrated embodiment, a pair of apertures are formed through each proximal end 270, and three holes are formed through each extension bracket 268. One of the apertures aligns with a central hole for receiving a pivot pin (as shown in FIG. 11) to provide the pivotal connection. The other aperture formed through the proximal end 270 aligns with a first hole when the extension arm 260, 262 is oriented in the deployed position, and aligns with a third hole when the extension arm 260, 262 is oriented in the storage position, such that a lock pin (not shown) may be inserted through the other aperture and the first or third hole for locking the extension arm 260, 262 in position.

Figure 14:
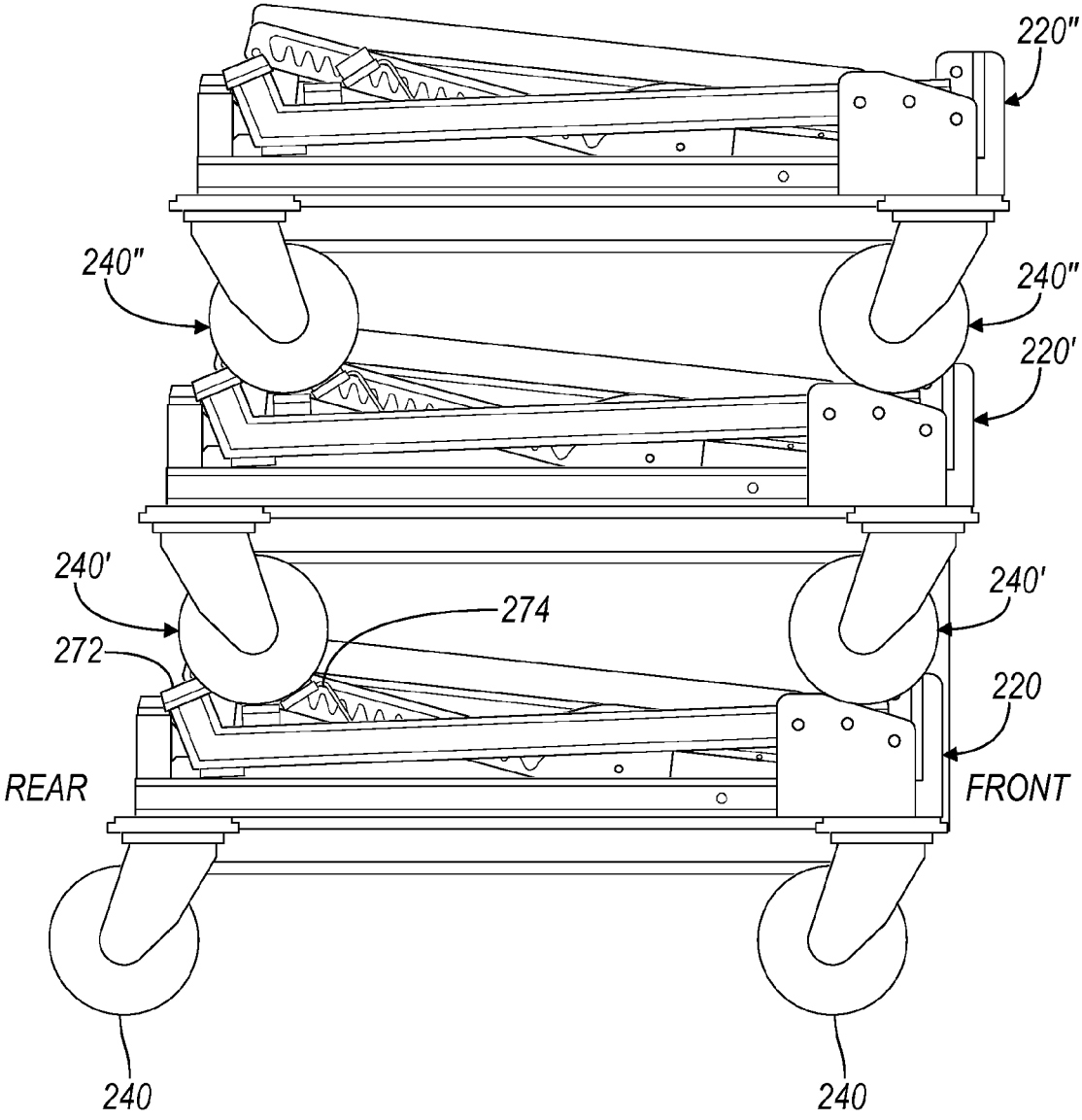
FIG. 14 is a side view of the cart assembly of FIG. 10, illustrated in the collapsed storage position and supporting two additional cart assemblies.

With reference to FIGS. 13 and 14, a wheel locator bracket 274 is mounted proximate to the distal end 272 of each extension arm 260, 262. The wheel locator bracket 274 includes two opposing lateral edges that are spaced apart from each other for receiving a wheel 240' of another cart assembly 220' that is stacked on top of the cart assembly 220. As illustrated in FIG. 14, the distal end 272 and the wheel locator bracket 274 are angled toward each other to collectively define a pocket for locating the wheel 240'. The wheel locator bracket 274 allows for compact storage of multiple cart assemblies 220, 220', 220" when they are oriented in the collapsed storage position.

Figure 15:
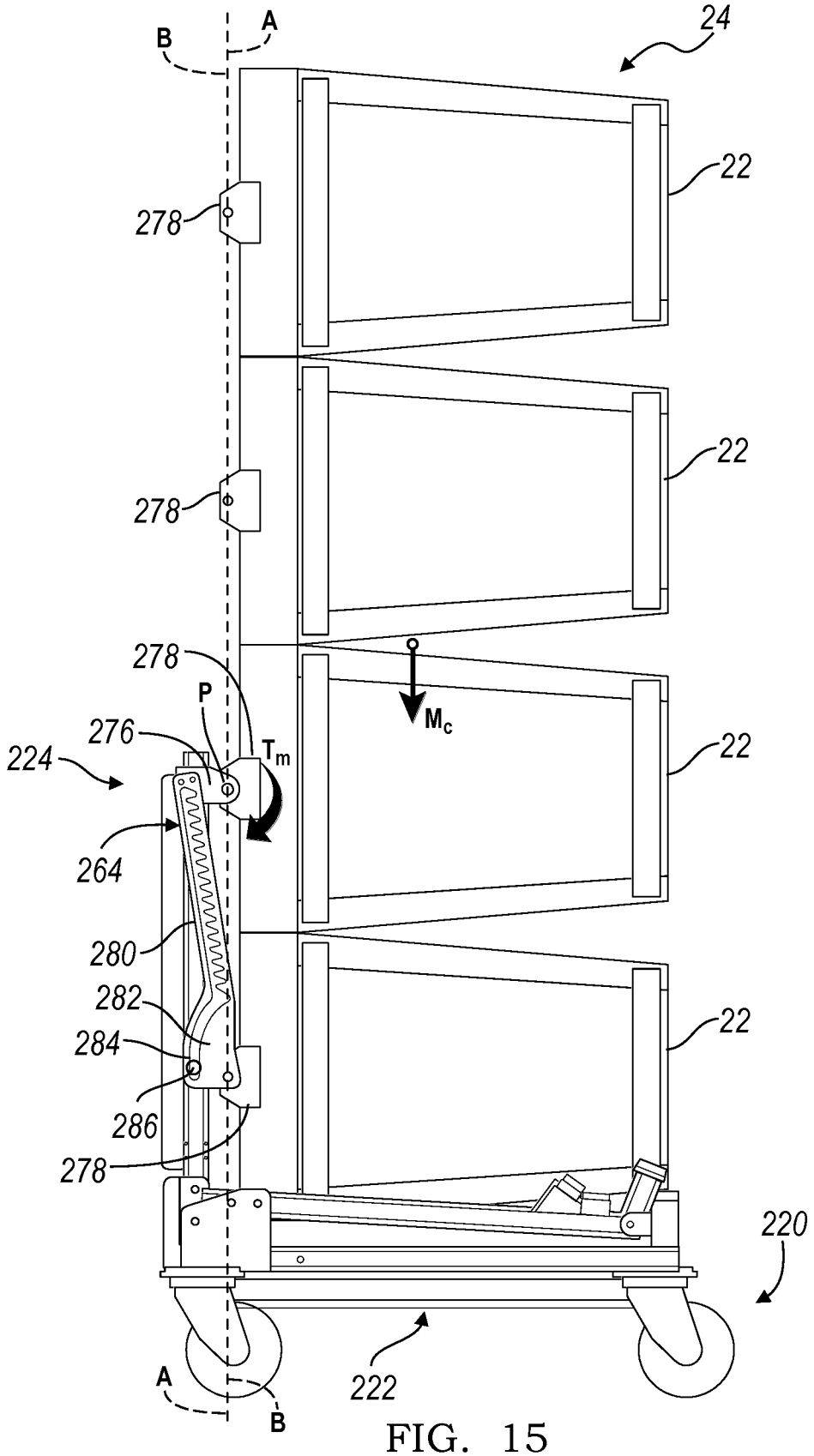
FIG. 15 is another side view of the cart assembly of FIG. 10, illustrated in an expanded storage position and supporting the line array of loudspeakers in an upright position.

With reference to FIGS. 15 and 16, the cart assembly 220 is configured to support the line array 24 of loudspeakers 22 as they are adjusted about an angle that is offset from an upright position. A longitudinal axis that corresponds to the upright position is referenced by Axis "A-A". A second axis that is aligned with a front surface of the loudspeakers 22 is referenced by Axis "B-B". FIG. 15 illustrates the line array 24 oriented in an upright position such that Axis A-A and Axis B-B overlap. FIG. 15 illustrates the line array 24 of loudspeakers 22 adjusted to an azimuth angle ($\alpha$) relative to Axis A-A.

The line array 24 of loudspeakers 22 is pivotally connected to the upright frame 224. A pair of pivot brackets 276 extend from opposing lateral edges of the upright frame 224, and are each pivotally connected to a corresponding loudspeaker bracket 278. The pivot brackets 276 are pivotally connected to an intermediate loudspeaker 22 (e.g., the loudspeaker 22 that is second from the bottom in the line array 24) at pivot point "P".

The right strut 264 and the left strut 266 (shown in FIG. 11) couple the line array 24 of speakers 22 to the upright frame 224 for translation. The strut 264 includes an elongate member 280 that extends from a proximal end 282. The proximal end 282 is pivotally connected to the loudspeaker bracket 278 of a lower loudspeaker (e.g., the loudspeaker 22 that is located on the bottom of the line array 24). A slot 284 is formed through the strut 264 and extends along the elongate member 280 in a generally linear path and along the proximal end 282 in an arcuate path. A pin 286 extends laterally outward from an intermediate portion of the right side support 246 and is received within the slot 284. As the azimuth angle (a) of the line array 24 is adjusted, the strut 264 translates relative to the pin 286 along the slot 284. For example, in FIG. 15 the pin 286 is located within the proximal end 282 and a is approximately zero degrees, and in FIG. 16 the pin 286 is located within the elongate member 280 and a is approximately forty-five degrees.

The strut 264 is configured to lock the line array 24 at a desired azimuth angle ($\alpha$). A series of teeth 288 are formed into the elongate member 280 and are spaced apart from each other along the slot 284. The teeth 288 are formed in a saw-tooth configuration which provides a ratcheting effect to allow one-way adjustment. With reference to FIGS. 15 and 16, as the line array 24 is pivoted in a counter-clockwise direction about P, the strut 264 translates to the right and the teeth 288 pass over the pin 286. However, each tooth 288 is configured to engage the pin 286 to prevent clockwise motion of the line array 24 about P.

The strut 264 limits the angular adjustment of the line array 24 of loudspeakers 22. The center of mass (Mc) of the line array 24 of loudspeakers 22 is illustrated in FIGS. 15 and 16. As illustrated in FIG. 15, when the line array 24 is oriented in the upright position, Mc is offset to the right of the longitudinal Axis (A-A) and over the base frame 222. The mass of the line array 24 creates a torque (Tm) about the pivot (P). When Mc is to the right of Axis A-A, Tm acts in a clockwise direction. However, as the azimuth angle ($\alpha$) increases, Mc approaches Axis A-A (FIG. 16). An endstop 290 is formed at a distal end 292 of the strut 264 that limits the angular adjustment of the line array 24 to a maximum azimuth angle ($\alpha$) of approximately forty-five degrees, to keep Mc to the right of A-A and biased over the base frame 222. If Mc were on the left of Axis A-A, then Tm would act in a counter-clockwise direction about P, and the cart assembly 220 could become unstable. Although FIGS. 15 and 16 only illustrate the right strut 264; the left strut 266 (FIG. 11) includes similar components as those described with reference to the right strut 264 for coupling the line array 24 to the upright frame 224 for translation during adjustment of the azimuth angle ($\alpha$). Additionally, the extension arms 260, 262 extend outward from the base frame 222 in the deployed position to stabilize the cart assembly 220 when a user is adjusting the azimuth angle ($\alpha$).

Existing methods (not shown) for connecting a loudspeaker to a previously suspended line array allow for connecting one loudspeaker at a time to the lowermost suspended loudspeaker and then adjusting the splay angle between the two loudspeakers. Such a method may result in multiple splay angle adjustments.

Figure 17:
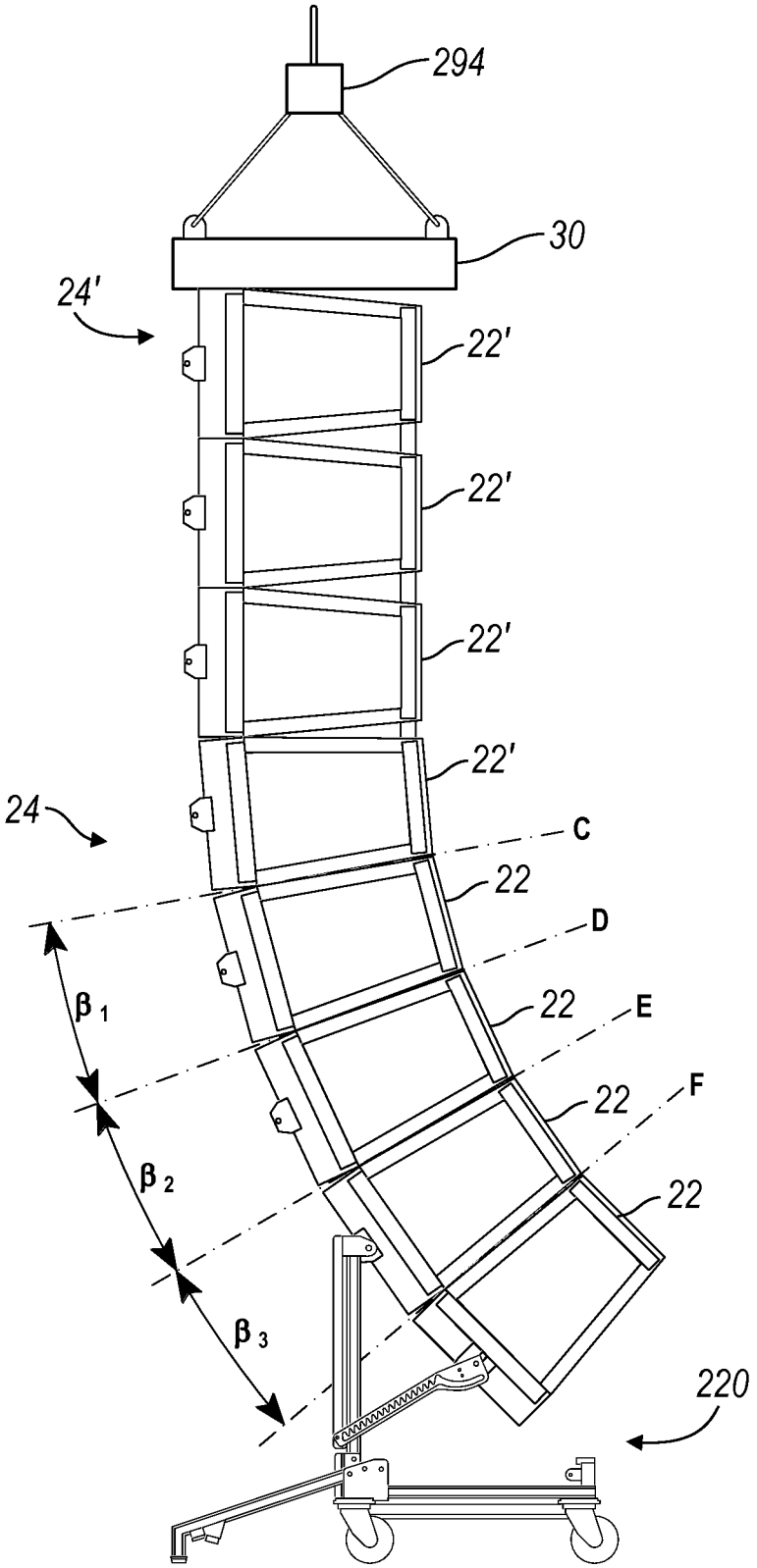
FIG. 17 is a yet another side perspective view of the cart assembly of FIG. 10, illustrated in the expanded deployed position and supporting the line array of loudspeakers at an angle offset from the upright position, the line array of loudspeakers illustrated in a curved configuration and attached to a suspended line array of loudspeakers.

With reference to FIG. 17, the cart assembly 220 allows for the adjustment of the splay angle ($\beta$) between multiple loudspeakers 22 within a line array 24 prior to connecting the line array 24 to a previously suspended line array 24'. The cart assembly 220 is illustrated supporting an array 24 of four loudspeakers 22. Splay angle $\beta_1$ represents the splay angle between an axis "C" extending through a first or top loudspeaker 22 and an axis "D" extending through second loudspeaker 22; splay angle $\beta_2$ represents the splay angle between axis D and an axis "E" extending through a third loudspeaker 22; and splay angle $\beta_3$ represents the splay angle between axis E and an axis "F" extending through a fourth loudspeaker 22. Once all the splay angles ($\beta_1$, $\beta_2$, $\beta_3$, $\beta_4$) are adjusted, the uppermost loudspeaker 22 of line array 24 is connected to the lowermost loudspeaker 22' of line array 24' and the combined suspended line array 24, 24' is lifted by a motor 294. Once the cart assembly 220 is lifted slightly off of the floor, the user may disconnect the cart assembly 220 from the line array 24.

In one or more embodiments a cart assembly is provided for transporting multiple loudspeakers that are stacked in a pre-assembled line array.

In another embodiment a cart assembly is provided with at least one base to support at least one loudspeaker. At least two wheels are mounted to the base, and a support extends from the base and away from the at least two wheels. The support is adapted to engage a loudspeaker frame. A locking mechanism is coupled to the support and adapted to selectively engage the loudspeaker frame. The locking mechanism is mounted for translation relative to the support between an engaged position and a released position.

In yet another embodiment, a cart assembly is provided with a base to support a loudspeaker array and an upright frame. The upright frame includes a proximal end that is connected to the base and a distal end spaced apart from the proximal end, with a pivotal connection that is adapted to receive at least one loudspeaker of the loudspeaker array. The cart assembly also includes at least one strut for providing a translational connection between the loudspeaker array and the upright frame to allow adjustment of an azimuth angle of the loudspeaker array about the pivotal connection relative to an upright axis.

As such, the cart assembly 20, 120, 220 allows for the loudspeakers 22 to be preassembled into line arrays 24, and then transported to the venue where the line arrays 24 are suspended or stacked and adjusted to a desired configuration. Such preassembly of the line arrays 24 reduces the amount of setup time at a venue, as compared to existing methods.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A cart assembly comprising:

a first base and a second base that are laterally spaced apart from each other to collectively support at least one loudspeaker cabinet;

a subframe extending between the first base and the second base;

at least two wheels mounted to each base;

a support extending from each base away from the at least two wheels; and a locking mechanism coupled to the support to selectively engage the loudspeaker cabinet, the locking mechanism being mounted for translation relative to the support between an engaged position and a released position.

2. The cart assembly of claim 1 wherein the locking mechanism engages a rear end of the loudspeaker cabinet; and wherein the cart assembly further comprises a projection extending from the support to engage a front end of the loudspeaker cabinet.

3. The cart assembly of claim 1 wherein the locking mechanism further comprises a first member that extends from the support and a second member that is coupled to the support, the first member having a pin extending therefrom to engage a rear end of the loudspeaker cabinet in the engaged position and to disengage the loudspeaker cabinet in the released position.

4. The cart assembly of claim 3 wherein the second member of the locking mechanism provides a support surface angled relative to the base to lift the rear end of the loudspeaker cabinet as the locking mechanism is translated to the engaged position.

5. The cart assembly of claim 1 further comprising at least one receptacle formed within the subframe and sized to receive a vehicle lift member.

6. The cart assembly of claim 1 further comprising a pin extending through an aperture formed through the support to engage the locking mechanism in the engaged position to lock the cart assembly to the loudspeaker cabinet.

7. A cart assembly comprising:

a base to support a loudspeaker cabinet array;

an upright frame with a proximal end connected to the base and a distal end spaced apart from the proximal end and adapted to pivotally connect to at least one loudspeaker of the loudspeaker cabinet array; and at least one strut providing a translational connection between the loudspeaker cabinet array and the upright frame to allow adjustment of an azimuth angle of the loudspeaker cabinet array about the pivotal connection relative to an upright axis.

8. The cart assembly of claim 7 wherein the strut comprises:

an elongate member coupled for translation to an intermediate portion of the upright frame, with a proximal end adapted to pivotally connect to the loudspeaker cabinet array; and an endstop formed at a distal end of the elongate member to limit adjustment of the azimuth angle.

9. The cart assembly of claim 8 wherein the strut further comprises a series of teeth formed therein and spaced along the elongate member, each tooth being adapted to engage the intermediate portion of the upright frame to adjust the loudspeaker cabinet array to an azimuth angle corresponding to the tooth.

10. The cart assembly of claim 9 wherein the series of teeth are formed in a sawtooth configuration to allow increasing adjustment of the azimuth angle and to lock against decreasing adjustment of the azimuth angle.

11. The cart assembly of claim 7 further comprising at least one extension arm pivotally connected to the base and adapted to adjust between a deployed position wherein the extension arm extends from the base and engages an underlying support surface, and a storage position wherein the extension arm extends over the base.

12. The cart assembly of claim 11 wherein each extension arm further comprises a locator bracket having a pair of laterally spaced apart edges that define a pocket adapted to receive a wheel of a vertically adjacent cart assembly in the storage position.

13. A loudspeaker transport system comprising:

a cart assembly according to claim 7; and a loudspeaker cabinet array including a lower loudspeaker cabinet pivotally connected to a first end of the strut and an intermediate cabinet pivotally connected to the distal end of the upright frame.

14. A method of transporting a plurality of loudspeakers, comprising:

providing a cart assembly having a base, and at least two wheels mounted to the base;

stacking a plurality of loudspeakers having a non-parallelogram cabinet on the base in a vertical line array with a splay angle between a pair of axes each extending through adjacent loudspeakers;

coupling the cart assembly to at least one of the plurality of loudspeakers;

adjusting a splay angle between vertically adjacent loudspeakers while the plurality of loudspeakers is supported by the cart assembly; and transporting the cart assembly and the plurality of loudspeakers to a desired location.

15. The method of claim 14 further comprising:

pivotally connecting a first loudspeaker of the plurality of loudspeakers to an upright frame extending from the base; and adjusting an azimuth angle of the plurality of loudspeakers relative to an upright axis.

16. The method of claim 15 further comprising a step for coupling a second loudspeaker of the plurality of loudspeakers to a distal end of a strut coupled for translation to the upright frame.

17. The method of claim 14 further comprising a step for connecting the plurality of loudspeakers to a suspended line array of loudspeakers after adjustment of the splay angle between vertically adjacent loudspeakers.

* * * * *